US007789590B2

(12) United States Patent
Morizot et al.

(10) Patent No.: US 7,789,590 B2
(45) Date of Patent: Sep. 7, 2010

(54) STABILIZING STRIP INTENDED FOR USE IN REINFORCED EARTH STRUCTURES

(75) Inventors: Jean Claude Morizot, Paris (FR); Nicolas Freitag, Orsay (FR)

(73) Assignee: Terre Armee Internationale, Velizy Villacoublay (FR)

( * ) Notice: Subject to any disclaimer, the term of this patent is extended or adjusted under 35 U.S.C. 154(b) by 0 days.

(21) Appl. No.: 12/251,696

(22) Filed: Oct. 15, 2008

(65) Prior Publication Data

US 2009/0123238 A1 May 14, 2009

(30) Foreign Application Priority Data

Oct. 16, 2007 (FR) ..... N 07 07241

(51) Int. Cl.
*E02D 29/02* (2006.01)

(52) U.S. Cl. ..... 405/262; 405/284; 405/286; 405/302.4

(58) Field of Classification Search ..... 405/262, 405/284, 285, 286, 258.1, 259.1, 302.4, 302.6, 405/302.7
See application file for complete search history.

(56) References Cited

U.S. PATENT DOCUMENTS

| | | | | | |
|---|---|---|---|---|---|
| 1,905,176 | A | * | 4/1933 | Kieckhefer | 405/15 |
| 4,116,010 | A | * | 9/1978 | Vidal | 405/262 |
| 4,710,062 | A | * | 12/1987 | Vidal et al. | 405/262 |
| 4,834,584 | A | * | 5/1989 | Hilfiker | 405/262 |
| 5,033,912 | A | * | 7/1991 | Vidal | 405/262 |
| 5,169,266 | A | * | 12/1992 | Sala et al. | 405/262 |
| 5,890,843 | A | * | 4/1999 | Bastick et al. | 405/262 |
| 6,050,746 | A | * | 4/2000 | McCavour et al. | 405/124 |
| 7,270,502 | B2 | * | 9/2007 | Brown | 405/262 |

FOREIGN PATENT DOCUMENTS

| | | | |
|---|---|---|---|
| GB | 2 014 221 | | 8/1979 |
| JP | 56039238 | A * | 4/1981 |
| WO | WO 95/11351 | | 4/1995 |
| WO | WO 2007/086634 | | 8/2007 |

OTHER PUBLICATIONS

Preliminary Search Report dated May 15, 2008 for FR 0707241.

* cited by examiner

*Primary Examiner*—Frederick L Lagman
(74) *Attorney, Agent, or Firm*—Frost Brown Todd LLC

(57) ABSTRACT

Stabilizing strip (10) intended for use in reinforced earth structures comprising laterally-opening notches (16) and/or pre-notches (17) making it possible to impose a finite radius of curvature on said strip (10).

14 Claims, 3 Drawing Sheets

STABILIZING STRIP INTENDED FOR USE IN REINFORCED EARTH STRUCTURES

BACKGROUND OF THE INVENTION

The present invention relates to a stabilizing strip intended for use in reinforced earth or strengthened soil structures, together with the use of such a strip for the construction of reinforced earth or strengthened soil structures.

A reinforced earth structure combines compacted backfill, a facing and reinforcements that are connected or not to the facing.

Various types of reinforcements can be used: metal reinforcements, for example galvanized steel rods, or flexible stabilizing strips, for example polyester fibre-based. They are implanted in the earth at a density dependant on the stresses which may be exerted on the structure. Mention can be made for example of the thrust stresses of the ground which are taken up by the friction between the earth and the reinforcements.

The facing is usually made from precast concrete elements in the form of slabs or blocks, juxtaposed to cover the front surface of the structure.

In certain cases, the reinforcements are supplied in the form of approximately parallelepipedal flexible strips, for example, the surfaces of which are all rectangular. Such strips commonly have a width greater than their thickness, for example ten times greater or even 100 times greater.

Such flexible strips can be approximately 3 to 10 meters long, although shorter or longer strips can be used. The width of such strips is generally between 4 and 6 centimeters, although it is possible to use strips ranging from 10 to 25 centimeters wide, or even more. Their thickness varies, for example, between approximately 1 millimeter and a few centimeters, and is generally between 1 and 6 millimeters.

Non-reinforced stabilizing strips or strips reinforced by means of, for example, parallel fibres or strands of yarn exist.

The aim of the stabilizing strips is to transmit the forces into the soil or the earth and thus distribute the stresses.

In particular, it is necessary to transmit the forces between a strip and the backfill in which it is placed. The strip must therefore have a sufficient surface area to develop, through friction, the required shear strength per unit of length.

Moreover, the strip is preferably capable of transmitting the stresses along its entire length, and therefore has high tensile strength.

A solution known to a person skilled in the art consists of using parallelepipedal polyethylene strips reinforced with polyester fibres arranged parallel to each other in the bulk of said strip.

Another solution, described in WO 95/11351, consists of using strips comprising a longitudinal part in the form of a central part in order to withstand a tensile force. The central part has two lateral parts which protrude laterally on either side of the central part to rub against the soil. The central part also comprises a set of fibres arranged so as to reinforce the tensile strength.

The use of such stabilizing strips in reinforced earth structures can present difficulties, in particular when obstacles are present in the structure. For example, the presence of vertical support columns or conduits can interfere with the positioning of the stabilizing strips.

Such a stabilizing strip has a high structural rigidity in its plane of installation. It is therefore very difficult to make such strips deviate in order to avoid any obstacles.

Such a stabilizing strip is generally arranged flat, its width and length being approximately in a horizontal plane, thus defining the principal plane of such a stabilizing strip.

A purpose of the present invention is to propose a stabilizing strip that can be made to deviate.

SUMMARY OF THE INVENTION

The invention thus proposes a stabilizing strip intended to be used in reinforced earth structures comprising notches and/or laterally-opening pre-notches making it possible to impose a finite radius of curvature onto said strip.

According to the invention, by laterally-opening is understood a notch or pre-notch, one end of which is situated within the bulk of the strip and another end of which opens at the surface of the strip on its lateral side.

Advantageously, the notches or pre-notches make it possible to impose a curvature on the stabilizing strip while retaining an adequate rigidity of the strip and a life span sufficient to ensure stabilization of the reinforced earth structure.

A stabilizing strip according to the invention can also comprise one or more of the optional characteristics below, taken individually or in any possible combination:

- said strip comprises at least one pair of notches or pre-notches, each notch or pre-notch of said at least one pair being symmetrically arranged on either side of the longitudinal axis of said strip,
- said strip is supplied in the form of an approximately parallelepipedal strip, for example, all the surfaces of which are rectangular,
- the notches or pre-notches extend approximately in the principal plane of said strip and across the width of said strip, said strip comprises a polymer-based matrix, for example polyethylene-based;
- the notches and/or pre-notches are capable of allowing a radius of curvature to be imposed, approximately in the principal plane of said stabilizing strip;
- said strip comprises a central part extending approximately along the longitudinal axis of said strip, said central part having laterally-protruding parts, where said lateral parts comprise notches and/or pre-notches;
- the laterally-opening notches and/or pre-notches are arranged at regular intervals on the lateral part of said strip;
- the laterally-opening notches and/or pre-notches are arranged at irregular intervals on the lateral part of said strip;
- said lateral parts have a smaller thickness than said central part from which they protrude;
- said central part comprises a longitudinal reinforcement having a high tensile strength;
- said longitudinal reinforcement is a cord and/or polymer fibres or yarn;
- the lateral part extends longitudinally.

A further subject of the invention is the use of a stabilizing strip according to the invention for the construction of a reinforced earth structure.

The invention also relates to a reinforced earth structure comprising at least one stabilizing strip according to the invention.

A further subject of the invention is a construction method for a reinforced earth structure, in which a facing is arranged over a front surface of the structure delimiting a volume to be backfilled, reinforcements are arranged in one zone of said volume, backfill material is placed in said volume and the backfill material is compacted, characterized in that said reinforcements comprise at least one stabilizing strip according to the invention.

The construction method for a reinforced earth structure according to the invention can comprise a step in which a radius of curvature between 1 and 10 meters is imposed on said stabilizing strip, as well as a step in which said at least one stabilizing strip is notched during installation.

It is possible to impose on the strip a plurality of radii of curvature and thus obtain a trajectory of any shape which can be envisaged.

The construction method for a reinforced earth structure according to the invention can moreover comprise installing the stabilizing strips in a single plane, as well as opening up any laterally-opening pre-notches during installation of the stabilizing strips.

BRIEF DESCRIPTION OF THE DRAWINGS

The invention will be better understood on reading the following description, given as an example only and with reference to the appended drawings, in which.

DETAILED DESCRIPTION OF THE INVENTION

For reasons of clarity, the various components shown in the Figures are not necessarily to scale.

By "longitudinal" is understood the direction along the longitudinal axis of the strip, the "lateral" direction being a direction approximately perpendicular to the longitudinal direction.

By "cord" is meant an assembly, obtained by twisting or plaiting, of at least three fibres made up of a plurality of strands of yarn, for example at least three strands of yarn, made from textile, synthetic, plastic or metal materials or a combination of these different fibres or yarns.

The cords chosen can for example be narrow, with a diameter in the region of one millimeter, or thicker, with a diameter in the region of one centimeter.

In the meaning of the invention, "pre-notch" denotes a part of the stabilizing strip which is prepared in order to be notched so as to form a laterally-opening notch. The pre-notch can be opened up in order to obtain the laterally-opening notch with little effort, for example by bending the stabilizing strip or also by breaking connecting points between the pre-notch and the stabilizing strip.

The pre-notch can consist, for example, of a discontinuous cut or a thinning of material depending on the notch required, or also a weak zone capable of being torn or degraded to form a notch.

Figure 1:
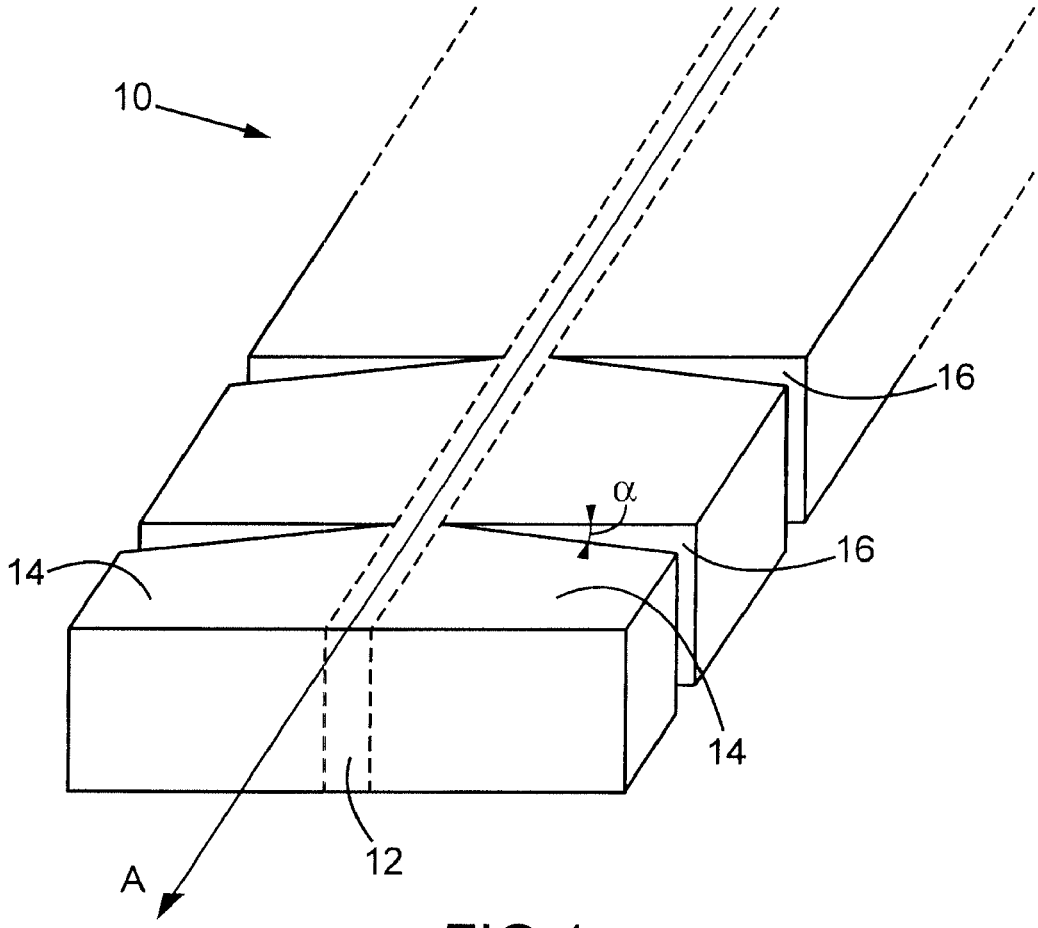
FIG. 1 is a diagrammatic perspective view of a first embodiment with lateral notches.

FIG. 1 shows a perspective view of a first embodiment of a stabilizing strip according to the invention.

In this first embodiment, the stabilizing strip 10 comprises a central part 12 which extends approximately along the longitudinal axis A of the stabilizing strip 10. Projecting laterally from each side of the central part 12, the stabilizing strip 10 comprises two lateral parts 14. Each lateral part comprises laterally-opening notches 16 arranged regularly on the lateral part 14 approximately laterally to the central part 12.

The central part 12 can be made from a plastic material such as polyethylene, polypropylene or PVC.

In this embodiment, the lateral parts 14 comprise a plurality of laterally-opening notches 16 arranged regularly in order to allow a radius of curvature to be imposed along the whole length of the strip 10.

The notches in this embodiment have an approximately triangular shape, but they could equally well have a rectangular, curved or irregular shape or also a combination of these different shapes.

In the case of triangular notches, the choice of the apex angle $\alpha$ of said triangle must be considered.

In fact, the greater the angle $\alpha$, the greater the curvature that can be given to the stabilizing strip.

The apex angle $\alpha$ of the triangular notch should not however be excessively increased, as this will result in a reduction in the material constituting the lateral parts, causing a prejudicial reduction in the surface of friction with the earth.

A compromise can therefore be determined. Thus, for example, the angle $\alpha$ is less than or equal to 90°, for example less than or equal to 50°, for example greater than or equal to 20°, for example greater than or equal to 40°.

Figure 2:
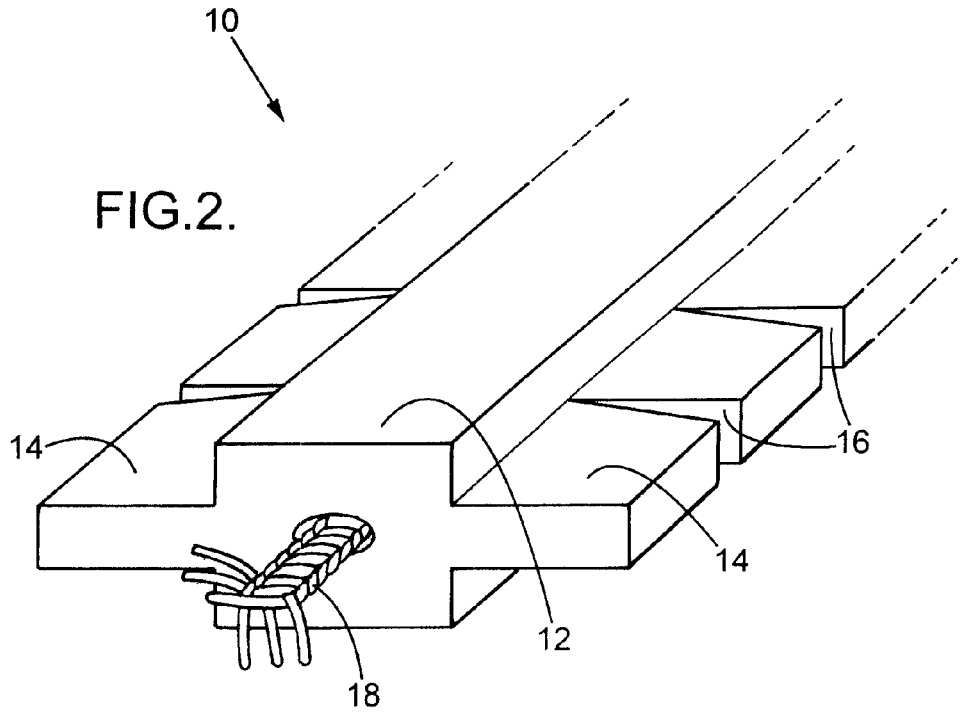
FIG. 2 is a diagrammatic perspective view of a second embodiment with laterally-opening notches.

In another embodiment, shown in FIG. 2, said stabilizing strip 10 according to the invention comprises a central part 12 extending approximately along the longitudinal axis of said strip.

Said central part 12 comprises a longitudinal reinforcement 18 having a high tensile strength and capable of accepting a radius of curvature in the principal plane of the strip.

In the embodiment shown in FIG. 2, the longitudinal reinforcement is in the form of one or more plaited cords 18, but it could also be in the form of one or more twisted cords or polymer fibres.

The longitudinal reinforcement can equally well be included in the overall bulk of the strip and not in the central part alone. The lateral parts can also comprise longitudinal reinforcements.

The central part 12 is extended laterally on two sides by two lateral parts 14 which protrude from said central part 12, in the form of wings.

The two lateral parts 14 are less thick than the central part 12.

One or both lateral part(s) 14 can be provided with ribs and/or undulations and/or perforations or any other means known to a person skilled in the art to improve the frictional interaction with the soil. Said lateral parts 14 comprise laterally-opening notches 16.

As in the embodiment in FIG. 2, the notches have an approximately triangular shape, but they could equally well have a rectangular, curved or irregular shape or also a combination of these different shapes.

Figure 3:
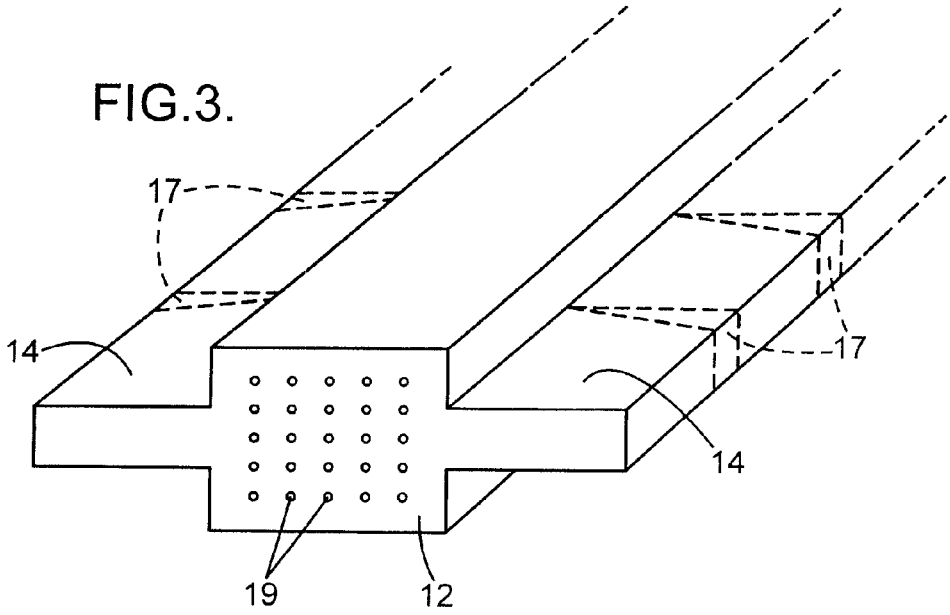
FIG. 3 is a diagrammatic perspective view of a third embodiment with laterally-opening pre-notches.

According to another embodiment shown in FIG. 3, the strip according to the invention can comprise pre-notches 17.

The stabilizing strip 10 shown in FIG. 3 comprises a central part 12 extending approximately along the longitudinal axis of said strip.

Said central part 12 comprises a matrix made of polyethylene reinforced with polyester fibres 19 arranged parallel to each other in the bulk of said central part 12.

In this embodiment, the lateral parts 14 comprise a plurality of laterally-opening pre-notches 17 arranged regularly in order to allow a radius of curvature to be imposed along the whole length of the strip 10 once these pre-notches 17 have been opened up.

The laterally-opening pre-notches 17 in this embodiment have an approximately triangular shape, but they could equally well have a rectangular, curved or irregular shape or also a combination of these different shapes.

In the case of triangular pre-notches, the choice of the apex angle $\alpha$ of said triangle must be considered.

For the same reasons as those explained in detail in the description of the embodiment in FIG. 1, the apex angle $\alpha$ of said triangle can be chosen less than or equal to 90°, for example less than or equal to 50°, for example greater than or equal to 20°, for example greater than or equal to 40°.

The use of laterally-opening pre-notches makes it possible to reduce the surface of the wings only when required. In fact, it is preferable to have a large contact surface between the lateral edges and the soil or the earth in order to increase the friction between the stabilizing strip and the earth and thus reinforce the earth.

A strip according to the invention can be produced, for example, by extrusion, co-extrusion, rolling or any other technique known to a person skilled in the art for producing metal or polymer strips.

The notches and/or laterally-opening pre-notches on the strips according to the invention can be obtained using a production method as described in WO 95/11351. Such a method can comprise passing the stabilizing strip between two rotary rollers which have on their periphery a suitable profile making it possible to cut the laterally-opening notches and/or pre-notches on the strips.

The invention also relates to a construction method for a reinforced earth structure.

Figure 4:
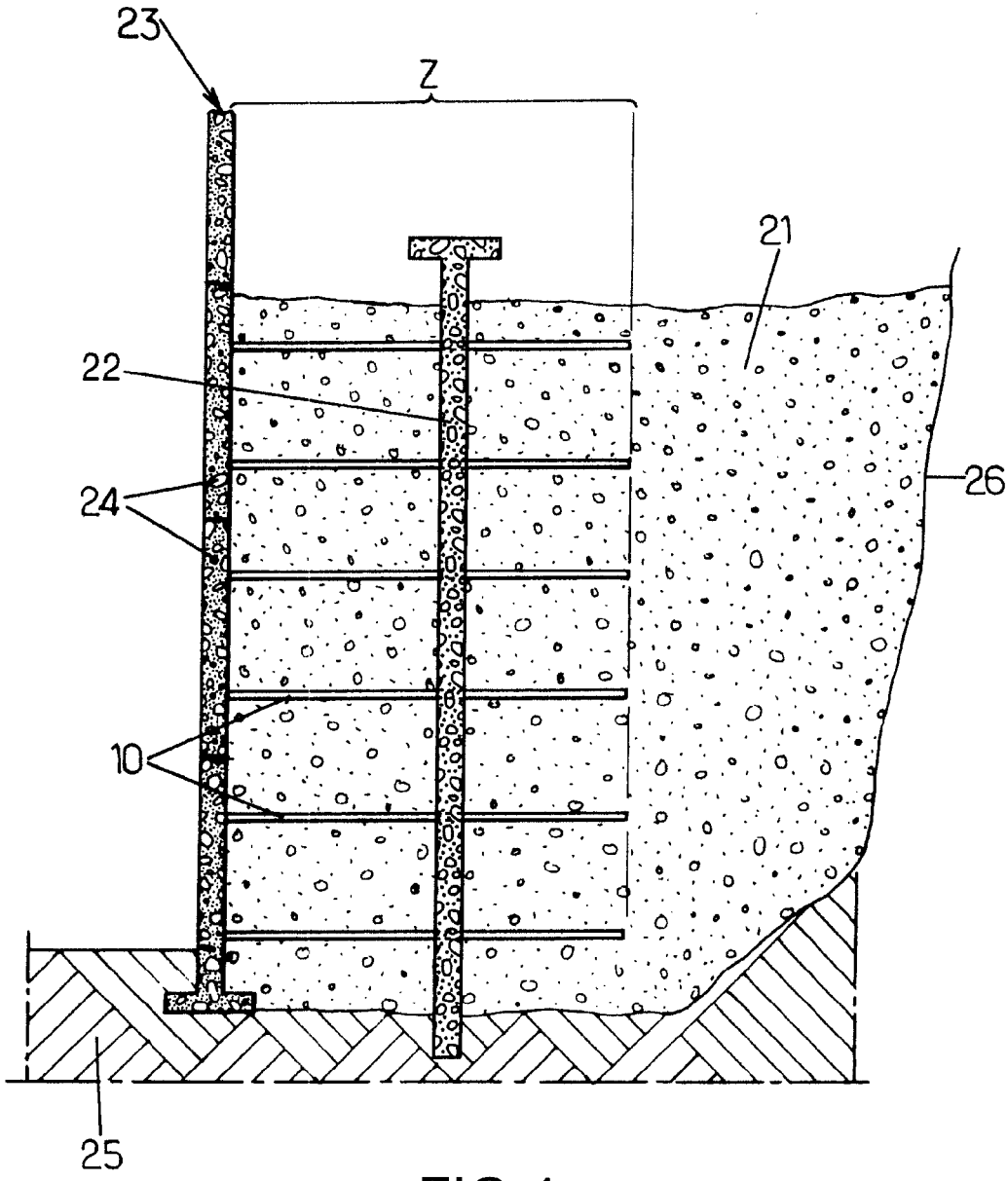
FIG. 4 is a diagrammatic cross-sectional view of a reinforced earth structure according to the invention under construction.

FIG. 4 illustrates such a method. Compacted backfill 21, in which stabilizing strips 10 according to the invention are distributed, is delimited on the front surface of the structure by a facing 23 formed by juxtaposing precast elements 24, and on the rear surface by the ground 25 against which the retaining wall is erected.

The compacted backfill 21 shown in FIG. 4 comprises a concrete foundation pier 22. The stabilizing strips according to the invention can avoid the pier 22 due to their notches and/or pre-notches.

To ensure the cohesion of the retaining wall, the stabilizing strips 10 can be connected to the facing elements 24, and extend over a certain distance within the backfill 21. These stabilizing strips 10 contribute to reinforcing the earth situated in the reinforced zone Z behind the facing 23.

In this reinforced zone Z, the backfill material 21 is highly cohesive due to the stabilizing strips 10. It is thus able to withstand the shear stresses which are exerted as a result of the tensile stresses undergone by the stabilizing strips 10.

Connecting stabilizing strips to the back of the facing elements 24 thus holds the facing against the backfill, of which there can be a large volume.

In a possible embodiment, the stabilizing strips 10 are integrated during the manufacture of the facing elements 24. In the frequent case where the elements 24 are made from precast concrete, a part of the stabilizing strips 10 can be embedded in the moulded concrete of an element 24. In the example structural configuration shown in FIG. 4, the stabilizing strips 10 are arranged in horizontal planes approximately parallel to each other over the height of the structure.

The following steps can be followed to build the structure shown in FIG. 4;

a) position some of the elements of the facing 24 and of the foundation pier 22 so that backfill material can then be added over a certain height. In a known manner, the assembly and positioning of the facing elements can be facilitated by fasteners placed between them;

b) install the stabilizing strips 10 on the backfill already present while imposing on them a radius of curvature so as to avoid an obstacle, in particular the foundation pier 22;

c) add backfill material on top of the layer of stabilizing strips 10 that has just been installed, up to the next level of stabilizing strips 10. This backfill material is compacted as it is added;

d) repeat steps a) to c) until the upper level of the backfill is reached.

The stabilizing strips can already comprise laterally-opening notches and/or pre-notches, the pre-notches can be opened up, for example cut, by the operator on site, just before installation of the strips. Moreover, the notches can be cut by the operator at the construction site, or even during installation, depending on the obstacles to be avoided.

A tool can then be used to cut the notches in situ, for example side-cutters or side-cutters with two series of blades facing each other, each series being positioned according to the required notch, for example V-shaped.

It must be noted that a large number of variants can be made to the structure described above and its method of realization.

The invention is not limited to these types of embodiment and must be interpreted in a non-limitative manner, encompassing any equivalent embodiment.

The invention claimed is:

1. Stabilizing strip intended to be used in reinforced earth structures comprising laterally-opening notches and/or pre-notches making it possible to impose a finite radius of curvature on said strip.

2. Stabilizing strip according to claim 1, wherein said strip comprises a polymer-based matrix, for example polyethylene-based.

3. Stabilizing strip according to claim 1, wherein the notches and/or pre-notches are capable of allowing a radius of curvature to be imposed, approximately in the principal plane of said stabilizing strip.

4. Stabilizing strip according to claim 1, comprising a central part extending approximately along the longitudinal axis of said strip, said central part having laterally-protruding parts wherein said lateral parts comprise notches and/or pre-notches.

5. Stabilizing strip according to claim 4, wherein the laterally-opening notches and/or pre-notches are arranged at regular intervals on the lateral part.

6. Stabilizing strip according to claim 5, wherein said lateral parts are less thick than said central part from which they protrude.

7. Stabilizing strip according to claim 4, wherein said central part comprises a longitudinal reinforcement having a high tensile strength.

8. Stabilizing strip according to claim 7, wherein said longitudinal reinforcement is a cord and/or polymer fibres or yarn.

9. Stabilizing strip according to claim 4, wherein the lateral part extends longitudinally.

10. Method of constructing a reinforced earth structure, using a stabilizing strip comprising laterally-opening notches and/or pre-notches making it possible to impose a finite radius of curvature on said strip.

11. Reinforced earth structure comprising at least one stabilizing strip, wherein said stabilizing strip comprising laterally-opening notches and/or pre-notches making it possible to impose a finite radius of curvature on said strip.

12. Construction method for a reinforced earth structure, in which a facing is arranged over a front surface of the structure delimiting a volume to be backfilled, reinforcements are arranged in one zone of said volume, backfill material is placed in said volume and the backfill material is compacted, wherein said reinforcements comprise at least one stabilizing strip comprising laterally-opening notches and/or pre-notches making it possible to impose a finite radius of curvature on said strip.

13. Construction method for a reinforced earth structure according to claim 12, wherein a radius of curvature of between 1 and 10 meters is imposed on said stabilizing strip.

14. Construction method for a reinforced earth structure according to claim 12, wherein said at least one stabilizing strip is notched during installation.

* * * * *